US007252481B2

(12) United States Patent
Stone

(10) Patent No.: US 7,252,481 B2
(45) Date of Patent: Aug. 7, 2007

(54) NATURAL FREQUENCY TUNING OF GAS TURBINE ENGINE BLADES

(75) Inventor: Paul Stone, Guelph (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 116 days.

(21) Appl. No.: 10/845,237

(22) Filed: May 14, 2004

(65) Prior Publication Data

US 2005/0254958 A1 Nov. 17, 2005

(51) Int. Cl.
*F01D 5/26* (2006.01)

(52) U.S. Cl. ..... 416/239; 416/500; 416/248

(58) Field of Classification Search ..... 416/144, 416/193 A, 215, 216, 218, 219 R, 220 R, 416/221, 239, 248, 500; 415/119; 29/401.1, 29/407.07, 889.21, 889.22, 889.23, 889.7
See application file for complete search history.

(56) References Cited

U.S. PATENT DOCUMENTS

| | | | | | |
|---|---|---|---|---|---|
| 2,873,088 | A | * | 2/1959 | Neumann | 416/193 A |
| 3,192,578 | A | * | 7/1965 | McCormick | 164/232 |
| 3,458,119 | A | * | 7/1969 | Shaw | 416/216 |
| 3,572,970 | A | * | 3/1971 | Smuland | 416/221 |
| 3,813,185 | A | * | 5/1974 | Bouiller et al. | 416/193 A |
| 3,832,092 | A | * | 8/1974 | Manharth | 416/220 R |
| 3,847,506 | A | | 11/1974 | Straniti | |
| 4,076,455 | A | * | 2/1978 | Stargardter | 416/500 |
| 4,097,192 | A | | 6/1978 | Kulina | |
| 4,453,890 | A | * | 6/1984 | Brantley | 416/220 R |
| 4,470,756 | A | * | 9/1984 | Rigo et al. | 416/220 R |
| 4,480,957 | A | | 11/1984 | Patel et al. | |
| 4,595,340 | A | * | 6/1986 | Klassen et al. | 416/193 A |
| 5,052,893 | A | * | 10/1991 | Catte | 416/220 R |
| 5,131,814 | A | * | 7/1992 | Przytulski et al. | 416/193 A |
| 5,160,242 | A | | 11/1992 | Brown | |
| 5,286,168 | A | | 2/1994 | Smith | |
| 5,836,744 | A | * | 11/1998 | Zipps et al. | 416/193 A |
| 5,947,687 | A | | 9/1999 | Mori et al. | |
| 6,042,338 | A | | 3/2000 | Brafford et al. | |
| 6,065,938 | A | * | 5/2000 | Bartsch | 416/219 R |
| 6,390,775 | B1 | | 5/2002 | Paz | |
| 6,481,967 | B2 | | 11/2002 | Tomita et al. | |
| 6,902,376 | B2 | * | 6/2005 | Gautreau et al. | 416/219 R |
| 2004/0076521 | A1 | * | 4/2004 | Martin et al. | 416/193 A |
| 2004/0213672 | A1 | * | 10/2004 | Gautreau et al. | 416/190 |
| 2004/0219024 | A1 | * | 11/2004 | Soupizon et al. | 416/219 R |

FOREIGN PATENT DOCUMENTS

| | | | | | |
|---|---|---|---|---|---|
| FR | 2358545 | A | * | 2/1978 | 416/193 A |
| GB | 532372 | A | * | 1/1941 | 416/193 A |
| GB | 574440 | A | * | 1/1946 | 29/889.7 |
| GB | 1268911 | A | * | 3/1972 | 29/889.7 |
| JP | 63-97803 | | | 4/1988 | |

* cited by examiner

*Primary Examiner*—Ninh H. Nguyen
(74) *Attorney, Agent, or Firm*—Ogilvy Renault

(57) ABSTRACT

A tuning notch is defined preferably in the back of a blade root to tune the blade natural frequency in a gas turbine engine.

13 Claims, 2 Drawing Sheets

NATURAL FREQUENCY TUNING OF GAS TURBINE ENGINE BLADES

BACKGROUND OF THE INVENTION

1. Field of the Invention

The present invention relates to gas turbine engines, and more particularly to the tuning of blades of such engines.

2. Background Art

An essential aspect in designing blades in a gas turbine engine is the tuning of the natural frequency of the blades, such as to avoid blade natural frequencies which coincide with known aerodynamic excitation frequencies. If the natural frequency of oscillation of a blade coincides with the harmonics of the aerodynamic excitation, a destructive resonance can result. Tuning the blades thus allows for minimal forced or resonant vibrations.

Blade tuning can be achieved in many ways. Known blade tuning techniques include varying blade design parameters such as tip profile, length, root thickness, or fixation angle. However, most known blade tuning techniques can have a detrimental effect on other important design parameters such as blade aerodynamics, stress distribution through the blade, manufacturability, or ease of assembly.

Accordingly, there is a need for improved blade tuning in a gas turbine engine.

SUMMARY OF INVENTION

It is therefore an aim of the present invention to provide an improved tuned blade for a gas turbine engine.

It is also an aim of the present invention to provide an improved method of tuning a gas turbine engine blade.

Therefore, in accordance with the present invention, there is provided a gas turbine engine blade comprising: a platform having a top surface and a bottom surface, an airfoil extending upwardly from said top surface of said platform, a root extending downwardly from said bottom surface of said platform, wherein said blade has a natural frequency, and wherein said natural frequency is tuned by a tuning notch defined in the root of the blade.

In accordance with a further general aspect of the present invention, there is provided a gas turbine engine fan comprising a rotor disc carrying a plurality of blades, each of said blades having a root depending from a bottom surface of a platform for engagement in a corresponding blade attachment slot defined in the rotor disc, and wherein each of said blades has a natural frequency, said natural frequency being tuned by a notch defined in said root.

In accordance with a further general aspect of the present invention, there is provided a method of tuning the natural frequency of a gas turbine engine blade having a root depending from a platform, the method comprising the step of: defining a notch in the root of the blade.

In accordance with a further general aspect of the present invention, there is provided a method of tuning a gas turbine engine blade having a platform and a root depending therefrom, the method comprising the steps of: a) ascertaining aerodynamic excitation frequencies to which the blade is subject during use, and b) altering the natural frequency of the blade in order to avoid the aerodynamic excitation frequencies by defining a notch in the root portion of the blade.

BRIEF DESCRIPTION OF THE DRAWINGS

Reference will now be made to the accompanying drawings, showing by way of illustration a preferred embodiment of the present invention and in which.

DESCRIPTION OF THE PREFERRED EMBODIMENTS

Figure 1:
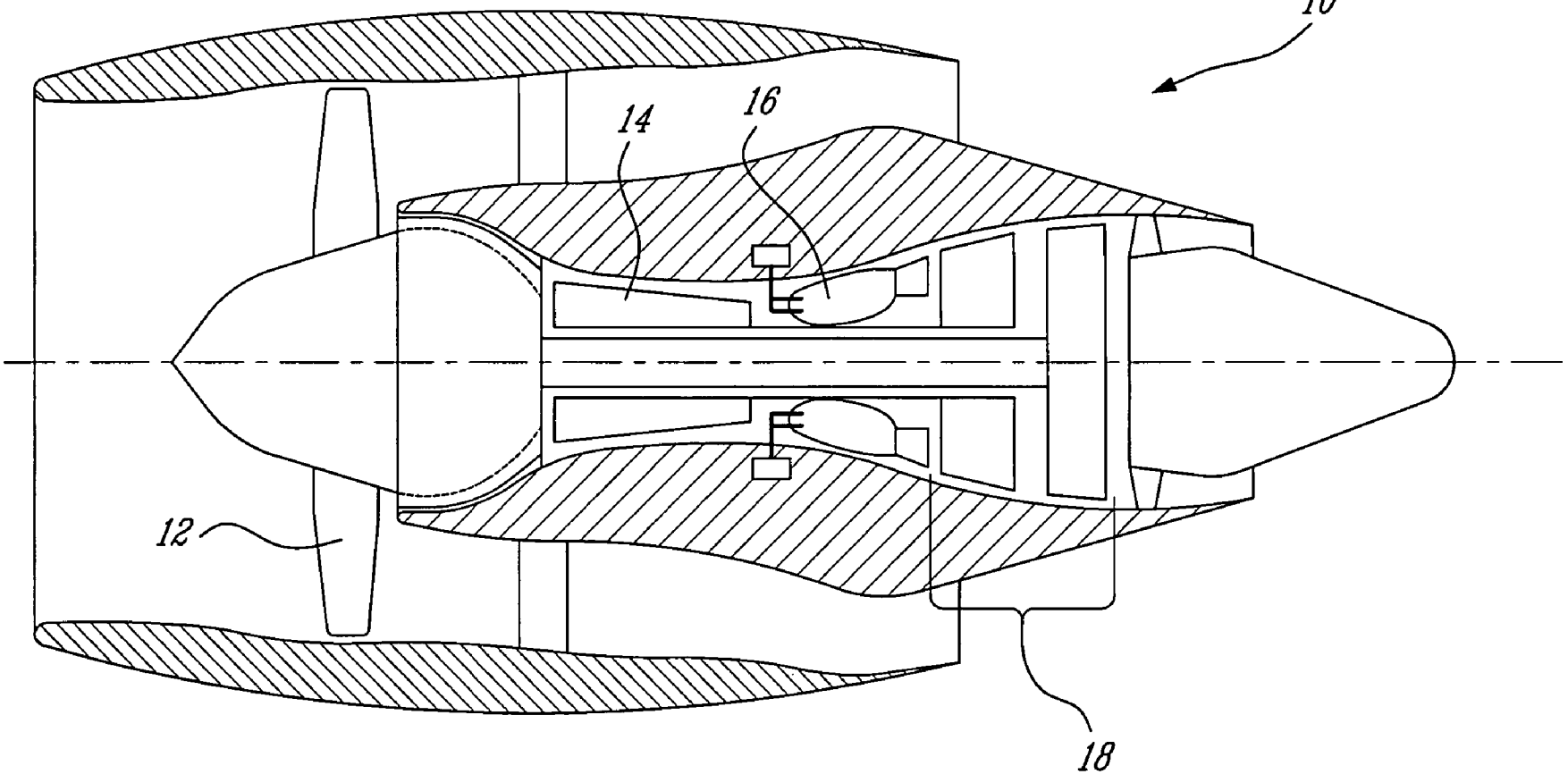
FIG. 1 is a side view of a gas turbine engine, in partial cross-section.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
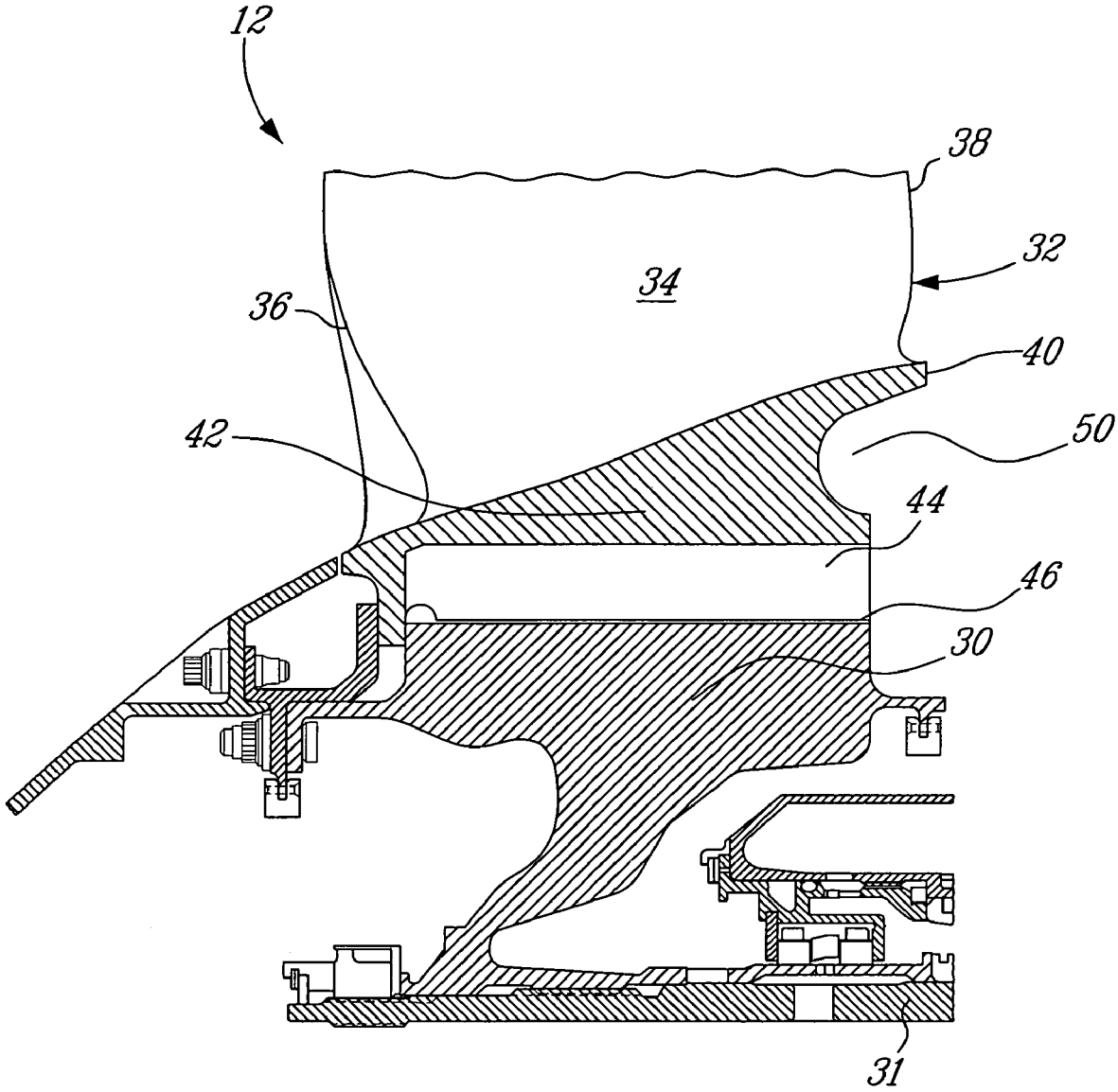
FIG. 2 is a partial side view of a fan, in cross-section, showing a blade root according to a preferred embodiment of the present invention.

Referring to FIG. 2, part of the fan 12, which is a "swept" fan, is illustrated. It is to be understood that the present invention can also be advantageously used with other types of radial fans, such as fans having blades which are symmetrical with respect to their radial axis, as well as other types of rotating equipment having blades which require tuning including, but not limited to, compressor and turbine rotors.

The fan 12 includes a disk 30, mounted on a rotating shaft 31 and supporting a plurality of blades 32 which are asymmetric with respect to their radial axis. Each blade 32 comprises an airfoil portion 34 including a leading edge 36 in the front and a trailing edge 38 in the back. The airfoil portion 34 extends radially outwardly from a platform 40. A blade root 42 extends from the platform 40, opposite the airfoil portion 34, such as to connect the blade 32 to the disk 10. The blade root 42 includes an axially extending dovetail 44, which is designed to engage a corresponding dovetail groove 46 in the disk 30. Other types of attachments can replace the dovetail 44 and dovetail groove 46, such as a bottom root profile commonly known as "fir tree" engaging a similarly shaped groove in the disk 10. The airfoil section 34, platform 40 and root 42 are preferably integral with one another.

According to a preferred embodiment of the present invention, the blade 32 is tuned by way of a notch 50 provided in the back of the blade root 42, between the platform 40 and the dovetail 44. The notch 50 is preferably rounded to minimize stress concentrations. The removal of root material involved in forming the notch 50 allows for a weight reduction as well as a variation in the center of gravity of the blade 32. Thus, the notch 50 will modify the natural frequency of the blade 32. Proper sizing and location of the notch 50 allow for the natural frequency of the blade 32 to reach a desired value.

Preferably, the tuning notch 50 is machined in the back of the root 42 after the aerodynamic excitation frequencies to which the blade will be exposed during used have been ascertained. In this way the notch can be designed to alter the natural frequency of the blade so as to avoid coincidence with the known aerodynamic excitation frequencies. The notch 50 can be defined in the root in any suitable manner as would be apparent to those skilled in the art.

Because the notch 50 is separated from a fan airflow by the platform 40, it will not affect the aerodynamic properties of the blade 32.

The highest stresses in the fixation of the swept blade 32 on the disk 30 are found at the front, where a significant portion of the blade weight is located. Defining the notch 50 in the back of the root 42, where the stresses are lower, allows for the notch 50 to have a negligible effect on the stress distribution in the fixation of the blade 32.

The notch 50 is easy to manufacture using standard machining equipment. The notch 50 does nor affect the assembly of the blades 32 on the disk 30 since it is defined away from the blade fixation, the dovetail 44. As clearly shown in FIG. 2, the notch extends axially inwardly relative to the back face of the disk 30 in axially overlapping relationship with the dovetail groove 46.

The notch 50 thus allows for a simple way to tune certain dynamic resonance modes while having minimum impact on other design parameters.

The embodiments of the invention described above are intended to be exemplary. Those skilled in the art will therefore appreciate that the foregoing description is illustrative only, and that various alternatives and modifications can be devised without departing from the spirit of the present invention. Accordingly, the present is intended to embrace all such alternatives, modifications and variances which fall within the scope of the appended claims.

The invention claimed is:

1. A gas turbine engine blade adapted to be mounted in a blade attachment slot, defined between a front face and a back face of a rotor disc mounted for rotation about an axis, the blade comprising: a platform having a top surface and a bottom surface, an airfoil extending upwardly from said top surface of said platform, a root extending downwardly from said bottom surface of said platform, said root having a disc engaging portion adapted to be received in the blade attachment slot, wherein said blade has a natural frequency, and wherein said natural frequency is tuned by a tuning notch defined in a back side of the root radially outwardly of said disc engaging portion and of the blade attachment slot when the blade is mounted therein, and wherein said tuning notch extends axially inwardly relative to the back face of the rotor disc and the blade attachment slot when the blade is operatively installed on the disc.

2. A gas turbine engine blade as defined in claim 1, wherein said tuning notch is defined immediately below said platform.

3. A gas turbine engine blade as defined in claim 1, wherein said tuning notch has a rounded profile.

4. A gas turbine engine blade as defined in claim 1, wherein said gas turbine engine blade is a swept fan blade.

5. A gas turbine engine blade as defined in claim 1, wherein said root has an axially extending dovetail, and wherein said tuning notch is radially spaced from said axially extending dovetail.

6. A gas turbine engine fan comprising a rotor disc mounted for rotation about an axis and carrying a plurality of blades, each of said blades having a root depending from a bottom surface of a platform, said root having a disc engaging portion for engagement in a corresponding blade attachment slot defined in the rotor disc, and wherein each of said blades has a natural frequency, said natural frequency being tuned by a notch defined in a back side of said root radially outwardly of said disc engaging portion and said blade attachment slot and wherein the notch extends axially inwardly relative to the back side of the disc and the blade attachment slot.

7. A gas turbine engine fan as defined in claim 6, wherein said notch is located next to said platform away from a bottom distal end of said root.

8. A gas turbine engine fan as defined in claim 7, wherein said fan is a swept fan.

9. A gas turbine engine fan as defined in claim 6, wherein said notch has a rounded profile.

10. A method of tuning the natural frequency of a gas turbine engine blade adapted to be mounted to a rotor disc mounted for rotation about an axis and having a back face, the blade having a root depending from a platform, the root having a disc engaging portion, the method comprising the step of: ascertaining aerodynamic excitation frequencies to which the blade is subject during use , adjusting the natural frequency of the blade such as to avoid the aerodynamic excitation frequencies by machining a notch in a back surface of the root of the blade between the platform and the disc engaging, the notch extending axially inwardly relative to the back face of the disc when the blade is mounted thereto.

11. A method as defined in claim 10, wherein the notch is located immediately below the platform.

12. A method as defined in claim 10, wherein the notch has a rounded profile.

13. A method of tuning a gas turbine engine blade received in an axially extending blade attachment slot defined in a disc mounted for rotations about an axis, the blade having a platform and a root depending therefrom, the root having a blade fixation portion adapted to be engaged with a disk, the method comprising the steps of: a) ascertaining aerodynamic excitation frequencies to which the blade is subject during use, and b) adjusting the natural frequency of the blade in order to avoid the aerodynamic excitation frequencies by defining a notch in a back surface or the root portion of the blade radially outwardly of the blade attachment slot and axially inwardly with respect thereto.

* * * * *